US011085744B1

(12) United States Patent
Han

(10) Patent No.: US 11,085,744 B1
(45) Date of Patent: Aug. 10, 2021

(54) BENDABLE PROJECTILE

(71) Applicant: U.S. Government as Represented by the Secretary of the Army, Dover, NJ (US)

(72) Inventor: Seungeuk Han, Highland Park, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 63 days.

(21) Appl. No.: 16/701,461

(22) Filed: Dec. 3, 2019

Related U.S. Application Data

(60) Provisional application No. 62/776,559, filed on Dec. 7, 2018.

(51) Int. Cl.
*F42B 10/60* (2006.01)
*F42B 10/06* (2006.01)

(52) U.S. Cl.
CPC ..... *F42B 10/06* (2013.01); *F42B 10/60* (2013.01)

(58) Field of Classification Search
CPC ..... F42B 10/60; F42B 10/62; F42B 10/32; F42B 10/38
See application file for complete search history.

(56) References Cited

U.S. PATENT DOCUMENTS

| | | | | |
|---|---|---|---|---|
| 4,220,379 | A | 9/1980 | Pimiskern | |
| 4,399,962 | A | 8/1983 | Wedertz | |
| 4,579,298 | A | 4/1986 | Thomson | |
| 4,793,571 | A | 12/1988 | Kranz | |
| 4,998,994 | A * | 3/1991 | Schmidt | F42B 10/02 244/3.1 |
| 5,139,216 | A | 8/1992 | Larkin | |
| 5,708,232 | A * | 1/1998 | Nedderman, Jr. | B63H 25/00 114/20.1 |
| 5,775,636 | A | 7/1998 | Vig | |
| 6,082,923 | A | 7/2000 | Maughan | |
| 9,027,441 | B2 | 5/2015 | Gewirtz | |

* cited by examiner

*Primary Examiner* — J. Woodrow Eldred
(74) *Attorney, Agent, or Firm* — John P. DiScala

(57) ABSTRACT

The present invention is directed to a bendable projectile having a forebody unit, a rearbody unit and an articulating joint unit connecting the two units. The articulating joint unit is composed of a spherical shape body, a receiving socket and a sphere-gear assembly. The spherical shape body is fitted into the receiving socket whereby movement of the spherical shape body about the receiving socket is permitted without release of the spherical shape body from the socket. Movement of the spherical shape body inside the receiving socket is effectuated by the sphere gear assembly. The sphere-gear assembly engages the concentric grooves along the surface of the spherical shape body or the concave surface of the receiving socket. Such sphere-gear assembly is comprised of electric board, powersource, powertrain, guidance control system and gears having teeth and grooves that complement the plurality of concentric grooves on the spherical shape body.

8 Claims, 15 Drawing Sheets

Schametics of a laser application on
the Bendable Projectile with the Sphere Gear Joint.

BENDABLE PROJECTILE

RELATED APPLICATIONS

This application claims the benefit of U.S. Provisional Application No. 62/776,559, filed on Dec. 7, 2018, the contents of which are incorporated herein in its entirety.

RIGHTS OF THE GOVERNMENT

The inventions described herein may be manufactured and used by or for the United States Government for government purposes without payment of any royalties.

FIELD OF INVENTION

The present invention is directed to projectiles and more specifically to projectiles where the forebody and rearbody units can move independently of each other utilizing an articulating joint units.

BACKGROUND OF THE INVENTION

Typically, projectiles in flight can change flight direction by controlling the canards, wings and fins, which may be connected to gear/actuator systems controlled by electromechanical power systems. Having such systems can lead to an increase in the numbers of movable parts, which increases the costs, and the potential for failure modes due to synchronization issues. Thus, a need exist for less expensive alternatives having more reliable guidance and control capabilities.

The present invention addresses this need by using a bendable projectile that can give the projectile more complex lift in conjunction with maneuvering. Specifically, the bendable projectile can bend, and therefore, produce nonzero chamber line angles to create pressure differences around the projectile contour that results in rearbody lift. This rearbody lift can add lift to the finner for range extension and to destabilize the spinner for range reduction. The present invention also functions to specify the impact angle in accordance with the functional requirements. The conventional projectile typically adjusts its entire rearbody to align with the specified impact angle, but the bendable projectile may meet this requirement by bending the forebody alone allowing for bigger maneuverability envelopes for the projectile. Being composed of multiple bodies, the bendable projectiles also allows for multiple rearbody penetrators as well. Another added benefit for the bendable projectile is the ability to bend the projectile forebody at a specific time, velocity or location, to destabilize the projectile to shorten the range. This feature is needed when a projectile is used in defense of populated areas where the projectile can intercept an incoming missile with maximum speed and stability, but can be made unstable and fall short if a target is missed to reduce unwanted collateral damage. A further added benefit to the bendable projectile is the ability to store, maintain and assemble separate components of the projectile before use. This increases the ease of inspection, maintenance and upgrades as well as customizing forebody and rearbody options based on mission needs.

SUMMARY OF THE INVENTION

It is an object of the invention to provide a bendable projectile having a forebody unit, a rearbody unit, and an articulating joint unit that connects the forebody unit with the rearbody unit. The articulating joint unit is comprised of a generally spherical shape body where the spherical shape body is comprised of a plurality of concentric grooves located on the surface of at least one polar end of the spherical shape body, and the spherical shape body is fixed either to the forebody unit or the rearbody unit. The stationary receiving socket for receiving and housing the spherical shape body is fixed on the projectile unit that is opposite from the spherical shaped body. A gear assembly is also provided that is fixed on the projectile unit that is opposite from the spherical shape body.

In one aspect of the invention, the bendable projectile is comprised of fins and canards.

In another aspect of the invention, the bendable projectile is comprised of a plurality of articulating joint units wherein said joint units may be present in the forebody and the rearbody unit.

It is further object of the invention to provide a bendable projectile having a forebody unit, a rearbody unit and an articulating join unit connecting the forebody unit and rearbody unit. The articulating joint unit comprises a generally hollow spherical shape body, a receiving socket and a sphere-gear assembly. The spherical shape body is fixed either to the projectile forebody unit or the projectile rearbody unit. The receiving socket is capable of housing a substantial portion of the spherical body within the socket. The receiving socket fixed on the projectile unit that is opposite from the spherical shape body has a plurality of concentric grooves on the concave surface of the receiving socket. The sphere-gear assembly is situated inside the generally hollow spherical body and fixed on the same projectile unit as the hollow spherical shape body. The sphere-gear assembly is comprised of a driving gear and a driven gear wherein the driven gear is in dynamic contact with the concentric grooves on the concave surface of the receiving socket.

In one aspect of the invention, the bendable projectile is comprised of fins and canards.

In another aspect of the invention, the bendable projectile is comprised of a plurality of articulating joint units wherein said joint units may be present in the forebody and the rearbody unit.

BRIEF DESCRIPTION OF THE DRAWINGS

Further features and advantages of the present invention may be understood from the drawings.

DETAILED DESCRIPTION

Figure 1:
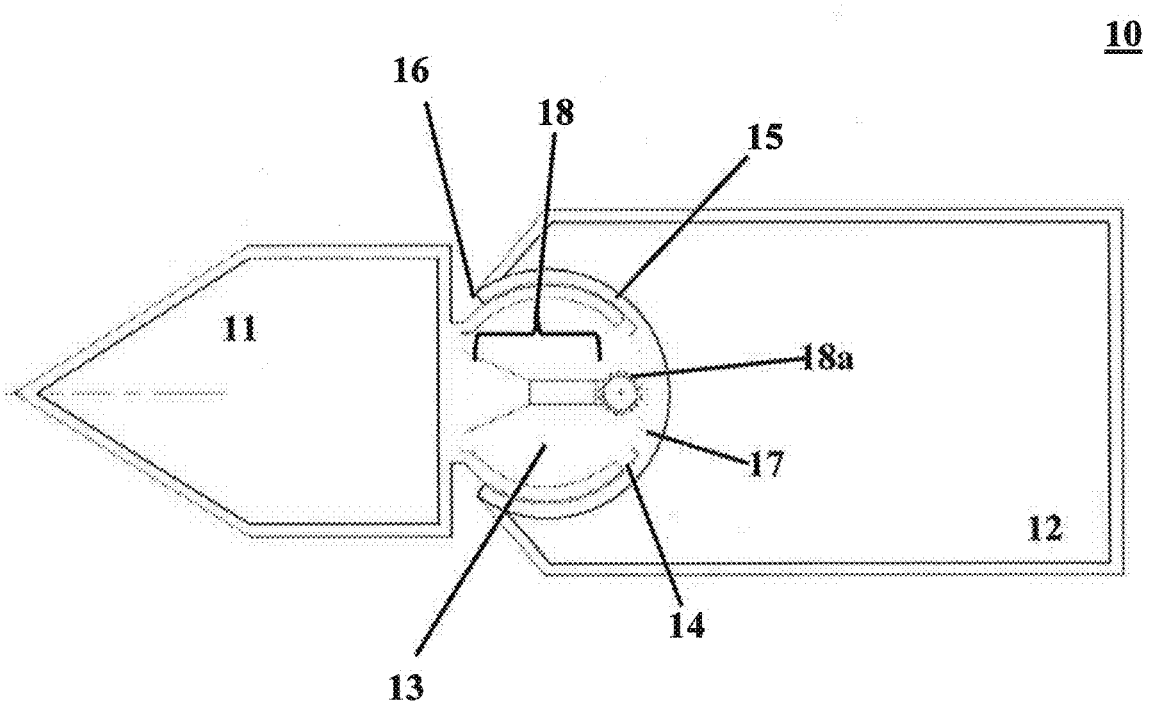
FIG. 1. A representative embodiment of a bendable projectile in a plus-configuration.

Disclosed herein is a bendable projectile having three units: a forebody unit, a rearbody unit and an articulating joint unit that connects both units. The forebody unit may have additional parts like canards, wings, bore-riders, etc. The rearbody unit may have fins for finners and a boattail for spinners. It is contemplated here that the bendable projectile can be a fin stabilized projectile or a spin stabilized projectile. The fin stabilized projectile can have none or low spin rate for stable flight. The spin stabilized projectile can typically have a high spin rate for stable flight.

The articulating joint unit is design to connect the two body units and to control the axial angle between the two bodies. The unique design provided herein is an improvement over conventional lift devices which utilizes wings, fins, and canards to provide aerodynamic lift to the projectile body. In contrast, the present invention takes advantage of the articulating unit to bend the forebody unit relative to the rearbody unit, which allows for the chamber line of the entire projectile rearbody to be in a positive or negative angle (See FIG. 1). Having a positive chamber line angle will result in a pressure differential between the upper and lower surface of the projectile giving it lift through aerodynamic forces. This force can be used to extend the range, to change the flight path as well as to change the flight angle (trim) including angle of attack.

The articulating joint unit is comprised of three main parts: a spherical shaped body, a receiving socket for the spherical shape body, and a gear assembly. The articulating joint unit functions to connect and grip the forebody unit with the rearbody unit and control the connected units to create bending angles. The grip function is achieved by a spherical shape body where a substantial portion of its sliding surface is situated inside a receiving socket and the turn function is perform by the dynamic interaction of the concentric circular grooves with the sphere gears system.

The spherical shape body should fit snugly within the receiving socket so the spherical shape body can freely rotate around the socket but does not come loose from the socket. The sphere-gear assembly is composed of a driver gear connected to a power source meshed with the driven gear in dynamic communication with the surface of the spherical shape body or the concave surface of the receiving socket.

The bendable projectile design allows for (1) controlling six (6) degrees of freedom of motion including independent spinning by controlling one or more unit(s) on the forerearbody unit, (2) reducing the electric consumption by using a smaller battery, (3) reducing components to decrease the unit cost, and (4) reducing the system complexity to eliminate unnecessary risks and failure thereby increasing reliability.

Articulating Joint Unit

The articulating joint unit is composed of 1) a spherical shape body that is fixed either to the forebody unit (or part thereof) or the rearbody unit, 2) a stationary socket that receives a substantial portion of the spherical shape body where the surface of the spherical shape body can easily slide within the receiving socket, and 3) a sphere-gear assembly for transmitting electrical energy into mechanical energy to move a portion of the spherical shape body in relation to the socket.

The articulating joint unit can be configured in a plus-configuration where the sphere-gear assembly fixed to a hollow spherical shape body interacts with a plurality of the concentric circular grooves located on the concave surface of the socket. Alternatively, the spherical shape body can be situated in a minus-configuration where the sphere-gear assembly fixed to the socket interacts with a plurality of concentric circular grooves located on the surface of the spherical shape body. In the minus-configuration, the spherical shape body can be solid or hollow as the circular grooves are located on the surface of the spherical shape body.

Articulating Joint Unit in Plus-Configuration A

FIG. 1 illustrates a bendable projectile having plus-configuration articulating joint unit in axial alignment with the bendable projectile 10 having a forebody unit 11 and a rearbody unit 12. The articulating joint unit is comprised of a spherical body 13 fixed to the forebody unit 11, a receiving socket 15 fixed to the rearbody unit 12 to receive the spherical body 13 which is hollow in this embodiment. The receiving socket has an opening 16 on one polar end of the longitudinal axis that is configured so that it is large enough to allow for movement of the spherical body and small enough to prevent the release of the spherical body from the receiving socket. Recommended size of the opening should be less than the diameter of the spherical body. On the opposite polar end of the opening is a plurality of concentric circular grooved rings 17 located on the concave surface of the receiving socket.

The hollow spherical body 13 nested inside the receiving socket is comprised of an opening 14 exposed to the circular grooved rings on the concave surface of the receiving socket. Movement of the hollow spherical body 13 in relation to the socket fixed on the projectile rearbody unit 12 is actuated by the sphere-gear assembly 18. The sphere-gear assembly having a gear end 18*a* that dynamically connects with the plurality of the circular grooves on the socket surface 17 to engage the hollow spherical body within the socket.

Articulating Joint Unit in Plus-Configuration B

Figure 2:
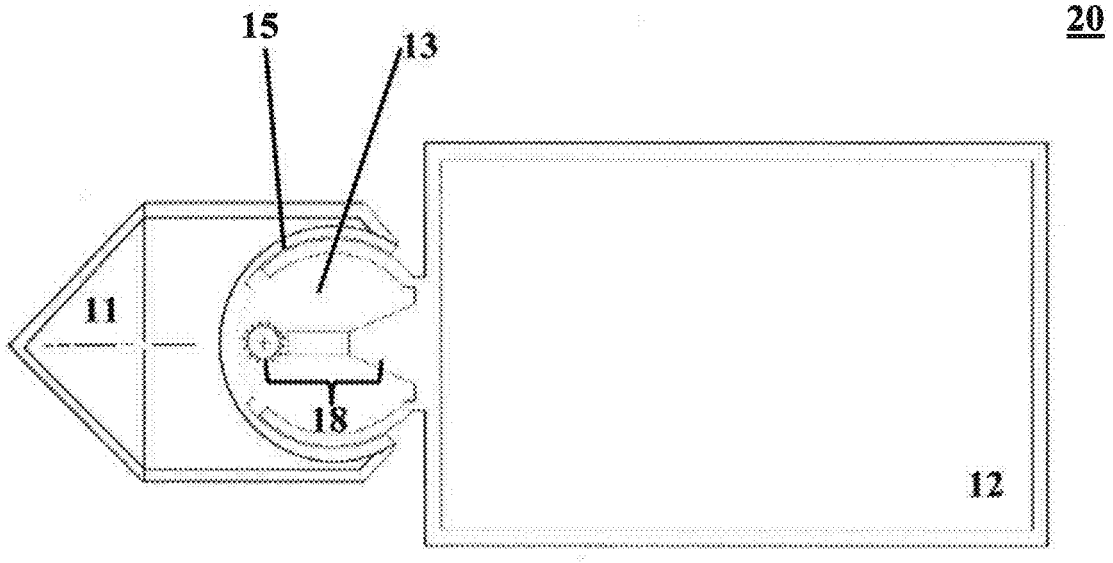
FIG. 2. A representative embodiment of a bendable projectile of FIG. 1 with the articulating joint assembly rotated 180 degrees.

FIG. 2 is an illustration of the articulating joint unit 20 of FIG. 1, where the orientation of the articulating joint unit is turned 180 degrees. In this orientation, the hollow spherical body 13 is fix on the rearbody unit 12. The socket 15 to receive the hollow spherical body 13 is fixed on the forebody unit 11. The sphere-gear assembly is fixed on the rearbody unit 12.

Articulating Joint Unit in Minus-Configuration A

In contrast to the plus-configuration articulating joint units illustrated in FIGS. 1 and 2 where the fixed concentric circular rings are located on the receiving socket, the minus-configuration has fixed concentric circular rings located on the outer surface of the spherical body. The sphere-gear assembly engages the circular rings to move the spherical body.

Figure 3:
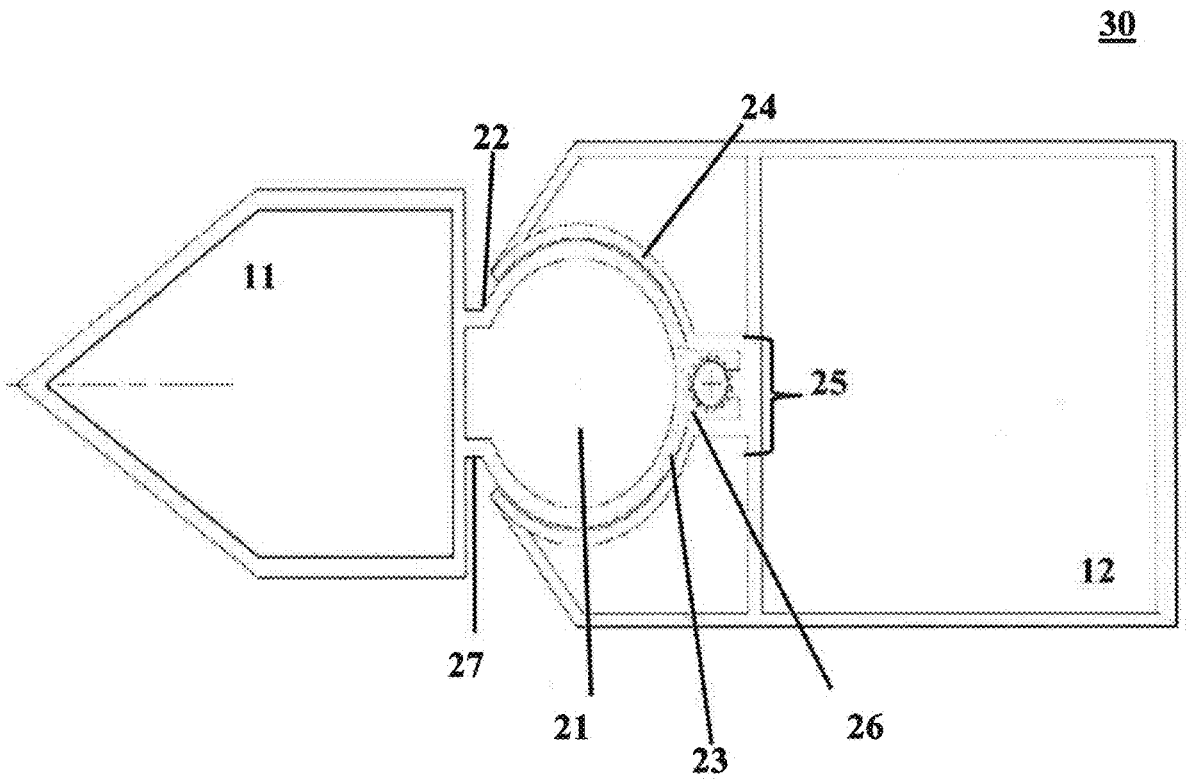
FIG. 3. A representative embodiment of a bendable projectile in a minus-configuration.

FIG. 3 is an illustration of an exemplary bendable projectile 30 having articulating joint unit consisting of a spherical body (either solid or hollow) 21 fixed on the forebody 11 nested inside a fixed receiving socket 24. On one polar end of the spherical body is a means 27 for fixing the spherical body 21 to the forebody. The means to attach the spherical body to the forebody can be any means well known in the field. On the opposite polar end of the longitudinal axis, the spherical body is comprised of a plurality of fixed concentric circular grooved rings 23. The fixed concentric circular grooved rings are in direct communication with the sphere-gear assembly 25 which is attached to the rearbody unit in this particular embodiment. The fixed socket has openings 22 and 26 to allow the spherical ball to be exposed on both polar ends to allow one end having the concentric circular groove rings 23 to dynamically engage with the sphere-gear assembly 25, and the other end to allow for movement of the spherical body within the socket. The circular grooved rings can extend beyond the opening of the fixed socket so that it may be partially covered by the socket.

Articulating Joint Unit in Minus Configuration B

Figure 4:
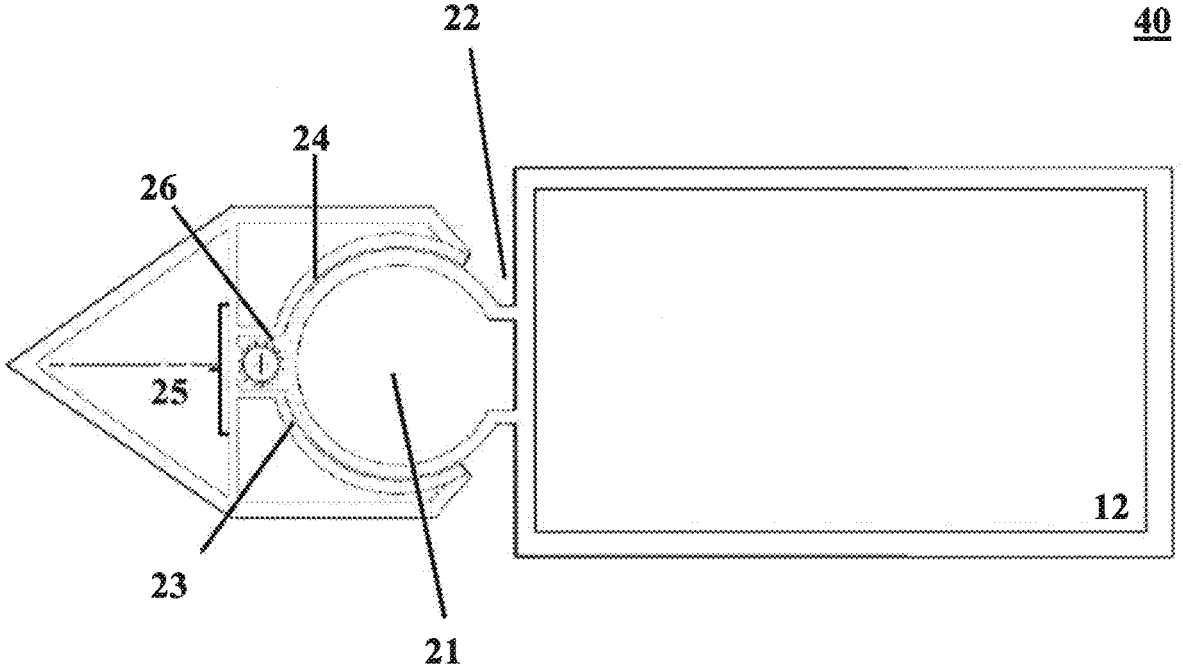
FIG. 4. A representative embodiment of a bendable projectile of FIG. 3 with the articulating joint rotated 180 degrees.

FIG. 4 is an illustration of another exemplary embodiment of a bendable projectile 40 where the articulating joint unit in the minus configuration B illustrated in FIG. 3 is oriented 180 degrees such that the spherical body 21 is fixed to the rearbody unit and nested inside the receiving socket that is fixed to the forebody segment 11. On the polar end facing the sphere gear assembly 25 are plurality of concentric grooves 23 located on the surface of the spherical body. The plurality of concentric grooves 23 are available for engagement with the sphere-gear assembly 25.

Sphere-Gear Assembly

The sphere-gear assembly controls the movement and direction of the spherical body by mating the groove and teeth surface of the gear end of the sphere-gear assembly with the concentric circular grooves found on the concave surface of the joint (plus-configuration, FIGS. 1-2) or outer surface of the spherical ball (minus-configuration, FIGS. 3-4).

Figure 5A:
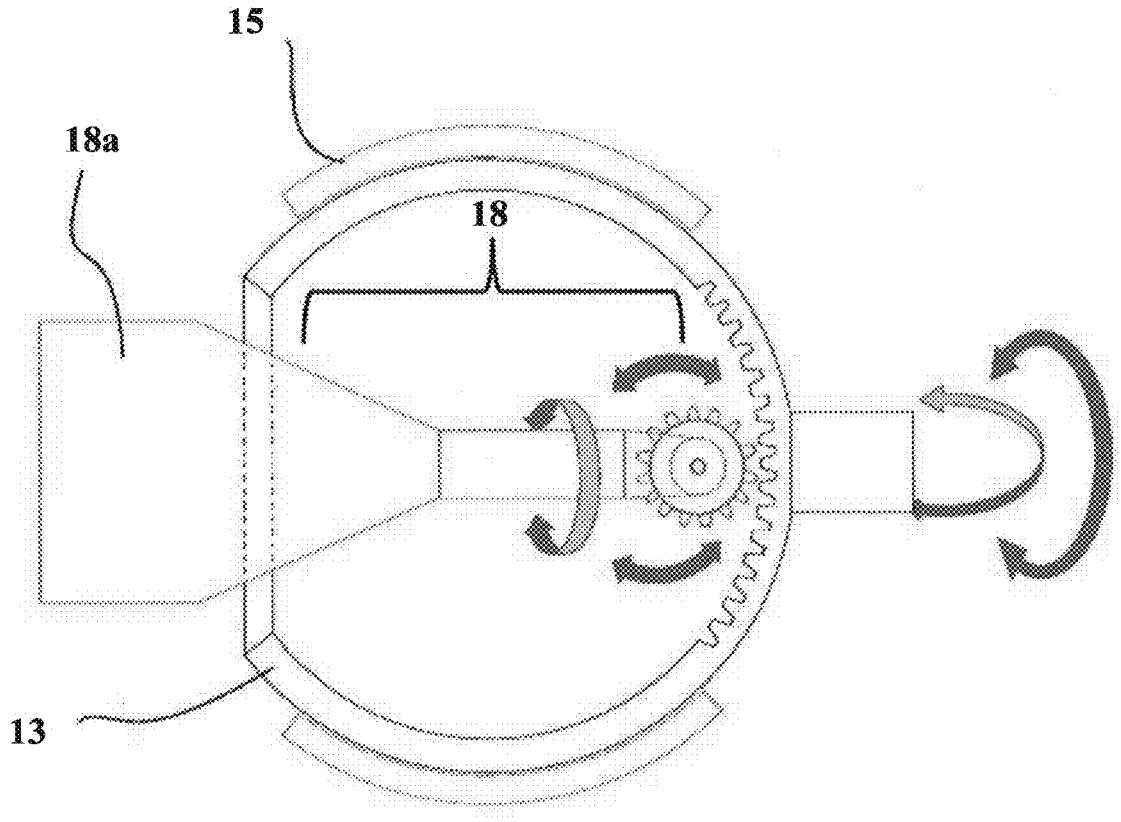
FIG. 5*a*. A cutaway of the articulating joint unit illustrated in FIG. 1.

FIG. 5*a* illustrates a cutaway of a plus-configuration articulating joint unit such as illustrated in FIG. 1, where the gear end of the sphere-gear assembly 18 engages the concentric circular grooves on the internal surface of a hollow spherical body to rotate the body 13 around the central axes. In this assembly, the socket 15 is fixed on a wall of the projectile. A two axial gear box 18*a* (e.g. spur, worm or etc.) is also fixed on a wall. The sphere-gear assembly may be comprised of an electric board, powersource (e.g. battery), powertrain (e.g. shaft, gearbox, motor, and communication wires), guidance control system, gears having teeth that complements the multiple concentric grooves on the surface of the spherical body to transmit speed, torque or direction to the spherical ball. Exemplary gears ends on the sphere-gear assembly include sphere-gear, worm gear as those well known in the field.

Figure 5B:
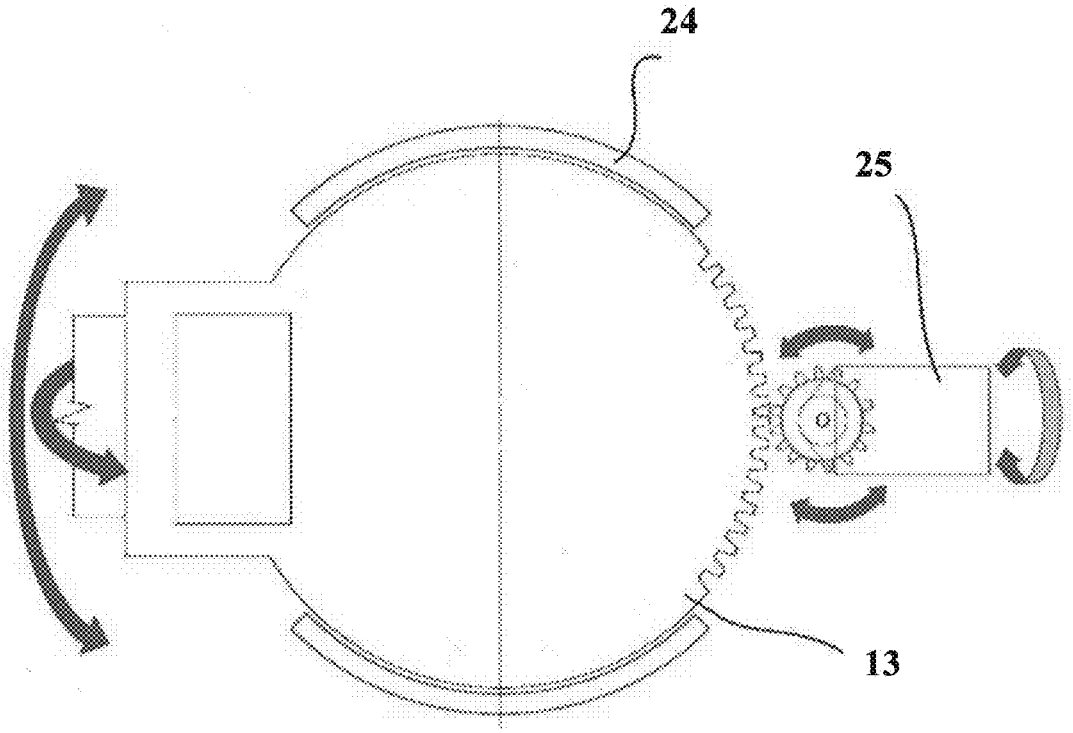
FIG. 5*b*. A cutaway of the articulating joint unit illustrated in FIG. 2 turned 180 degrees.

FIG. 5*b* is an illustration of a minus-configuration of the articulating joint unit as illustrated in FIG. 3 where the spherical body 13 is rotated by the sphere-gear assembly having a two axial gear box (e.g. spur, worm or etc.) that is fixed on a wall.

Figure 6A:
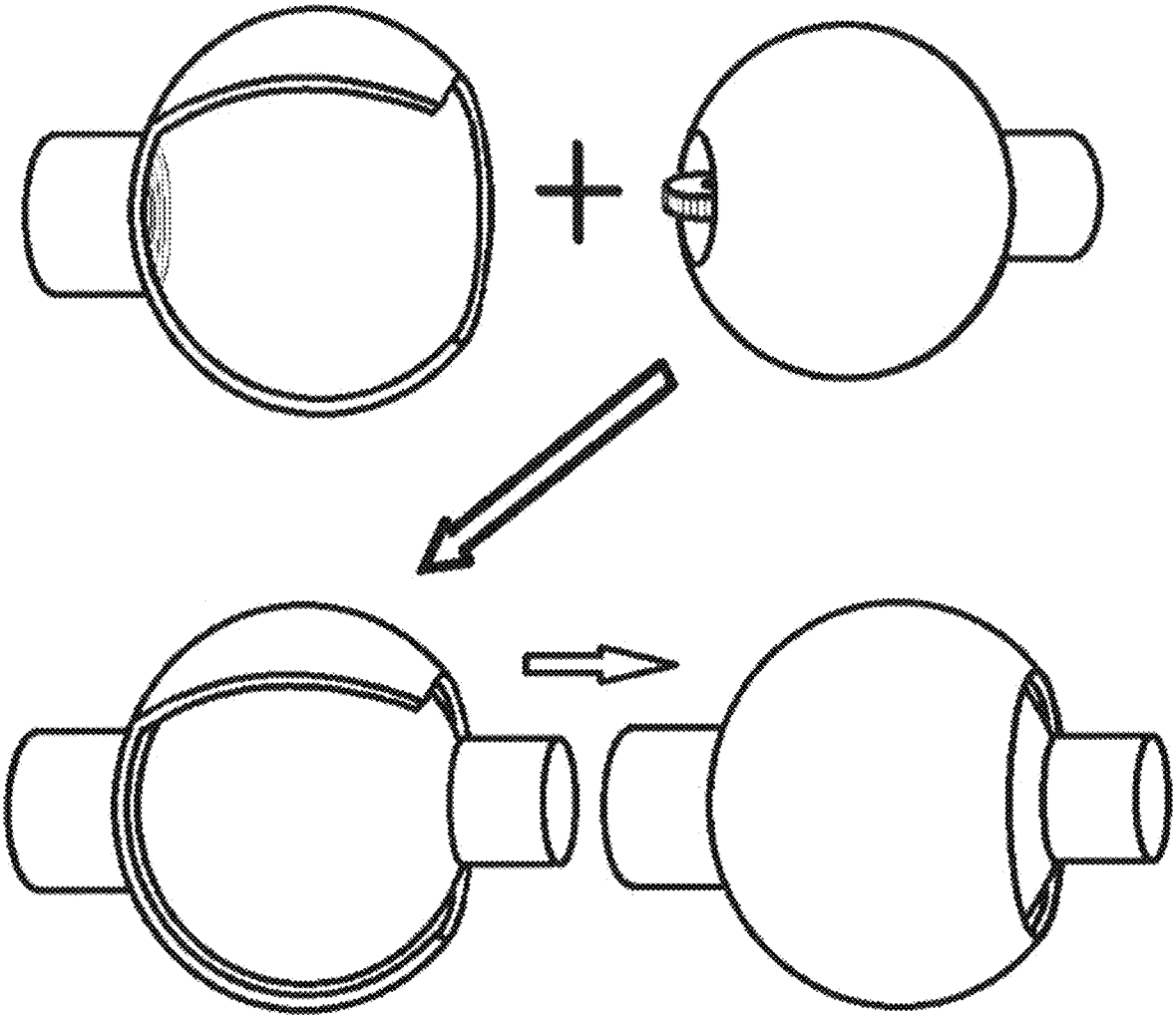
FIG. 6*a*. An illustration of how a spherical shape body fits into the receiving socket in the plus-configuration.

FIG. 6*a* illustrates how the spherical body fits into the receiving socket in the exemplary plus-configuration. The tilting angle can be controlled continuously and simultaneously.

Figure 6B:
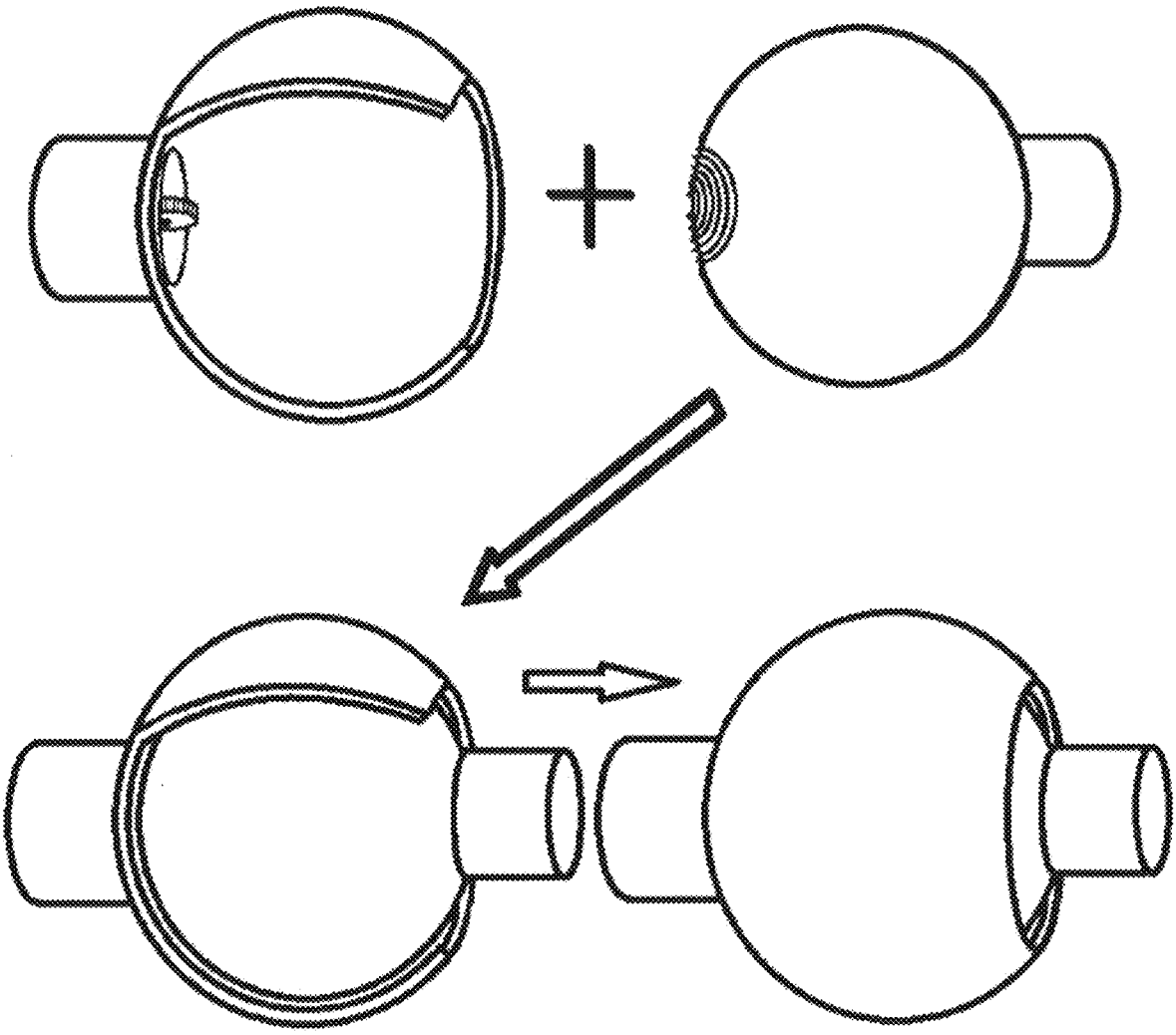
FIG. 6*b*. An illustration of how the spherical shape body fits into the receiving socket in the minus-configuration.

FIG. 6*b* illustrates the how the spherical body fits into the receiving socket for the exemplary minus-configuration.

Figure 7:
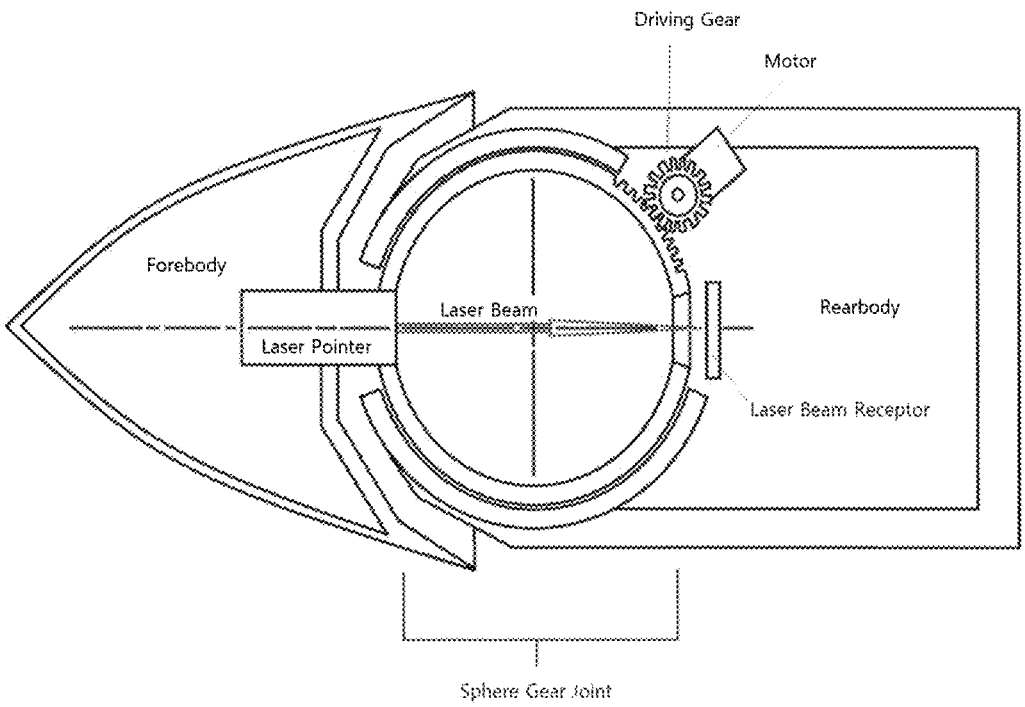
FIG. 7. A representative embodiment of a bendable projectile with a laser pointer.

The alignment of the forebody and the rearbody can be done by utilizing many off-the-shelf applications including an optional laser pointer. FIG. 7 illustrates a laser pointer mounted on the forebody with a laser beam directed towards the rearbody. The sphere gear system with the driving gear can be mounted off from the longitudinal axis.

Bendable Projectile I

Other possible projectile configurations are available using the articulating joint unit disclosed herein. In the one configuration, one unit can bend independent of the other to control the lift of the projectile (Projectile II) and in another configuration, the forebody can bend to allow for complex maneuvering (Projectile I).

Figure 8A:
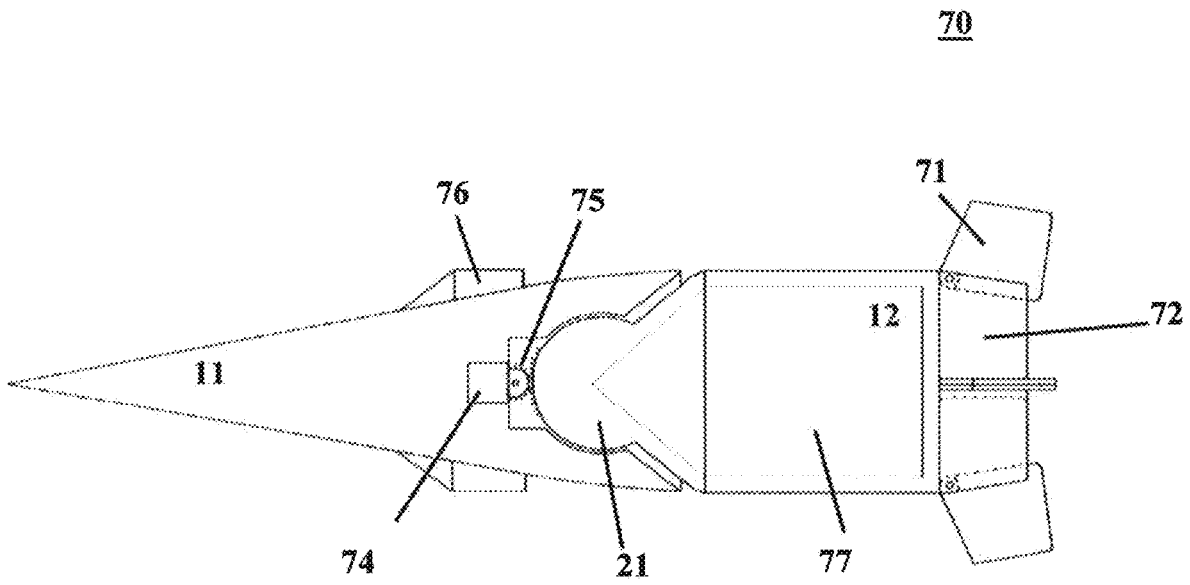
FIG. 8*a*. An exemplary embodiment of a bendable projectile I (minus configuration) having fins, boat tail, and canards.

FIG. 8*a* illustrates the bendable projectile 170 (minus-configuration) having an forebody unit 11 and a rearbody unit 12 connected by the articulating joint unit. This bendable projectile 70 can have fins 71 connected to the boattail 72 and canards 76 connected to the forebody 11 for further guidance and control of the projectile. Further illustrated here are some components of the articulating joint unit such as the guidance and control electric board unit 74 and gear box 75 connected to the spherical shape body 21.

Figure 8B:
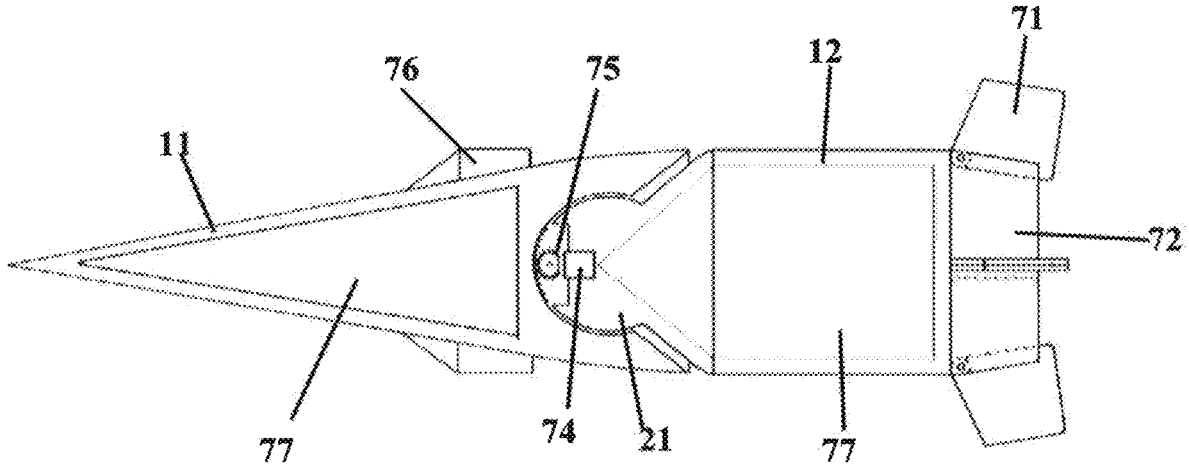
FIG. 8*b*. An exemplary embodiment of a bendable projectile II (plus configuration) having fins, boat tail, and canards.

FIG. 8*b* illustrates the bendable projectile I 70 (plus-configuration) having the guidance and control electric board unit 74 and gear box 75 located inside the spherical shape body 21.

Bendable Projectile II

In another embodiment, the bendable projectile II has one or more bendable joints located somewhere near the tip of the forebody unit to take advantage of the inertia differences between the forebody and rearbody units. For example, a projectile can typically change flight direction by controlling lifting surfaces like canards. This can also be achieved by bending the rearbody instead of controlling the canards or fin device alone. The benefit of this method is to reduce the gear/actuation mechanisms of each device into one articulating joint unit as oppose to 2, 4, 6 or multi-axis canard actuation systems.

Figure 9:
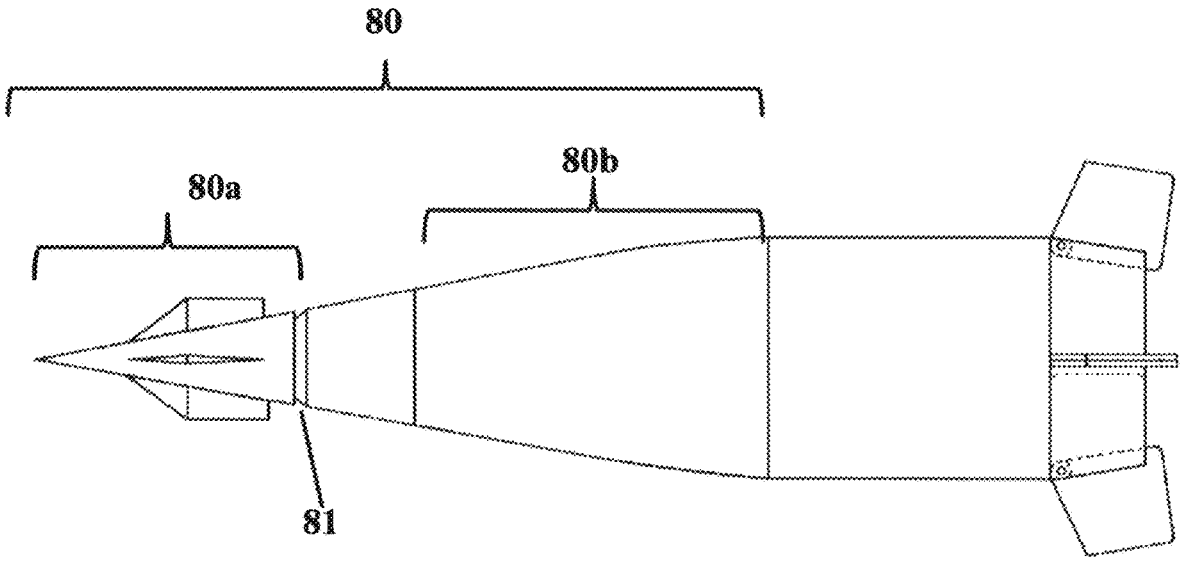
FIG. 9. An exemplary embodiment of a bendable projectile having folding fins and canards.

FIG. 9 illustrates an exemplary bendable projectile having four folding fins located in the rear stabilizer and four canard/bore riders. Depending on the particular needs, the canard/bore riders can be 6 or 8 as well. The exemplary projectiles discussed herein is a finner, but the invention described herein may also apply to spinner projectiles where the bending tip can be decoupled to the spin rate. The articulating joint unit may be located on the forebody 80 such as near the nose unit 80*a* depending on the amount of rearbody control need on the nose tip or as illustrated in previous embodiments in the lower forebody unit where the forebody meets the rearbody of the projectile.

Figure 9A:
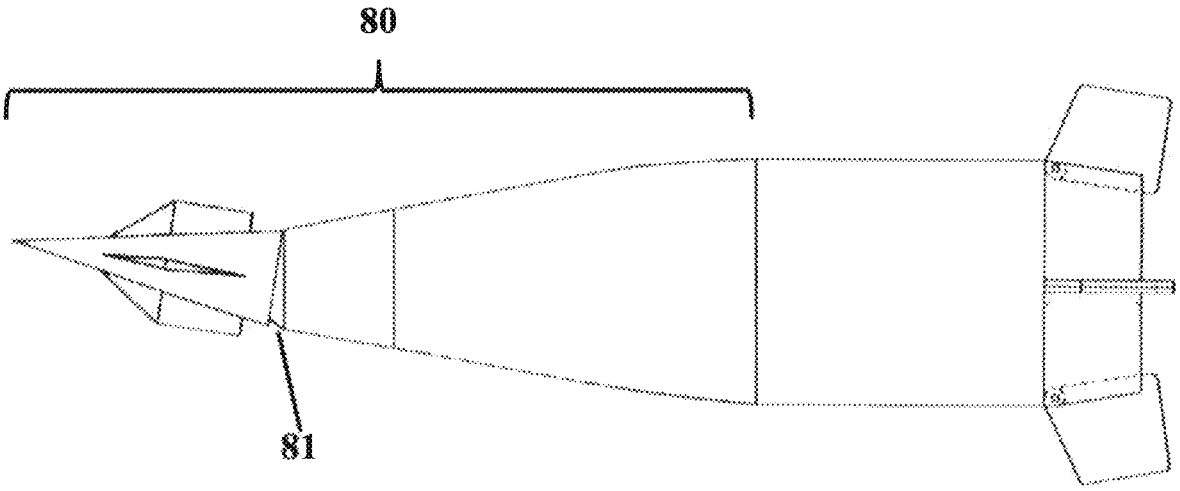
FIG. 9*a*. An exemplary illustration of the bendable projectile where the forebody is articulated in a positive angle during flight.
Figure 9B:
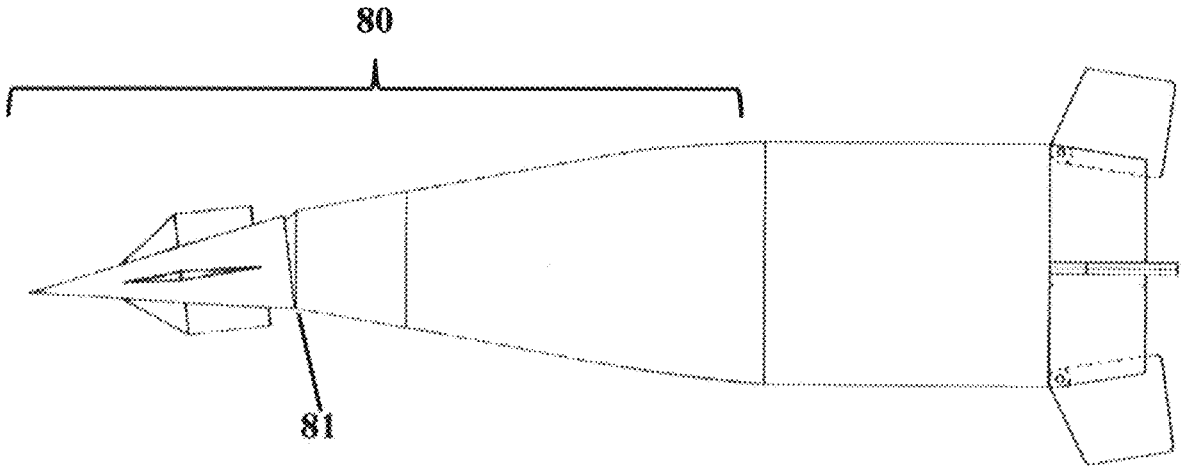
FIG. 9*b*. An exemplary illustration of the bendable projectile where the forebody is articulated in a negative angle during flight.

FIGS. 9*a* and 9*b* illustrates exemplary flight scenarios of the projectile in FIG. 9 having a single articulating joint unit on the nose tip.

Figure 10:
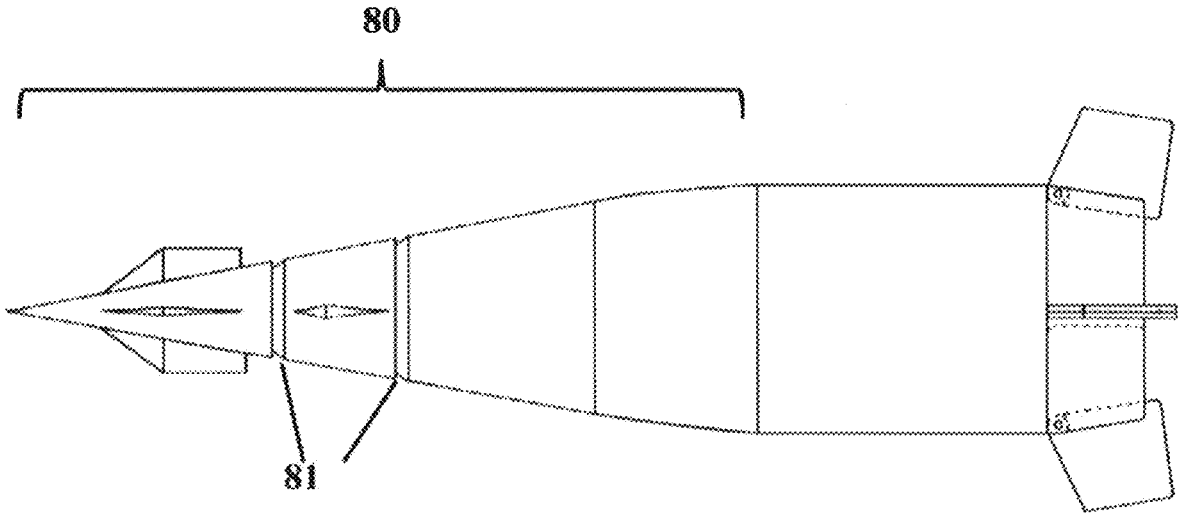
FIG. 10. An exemplary illustration of the bendable projectile having a plurality of articulating joint units.

It is further contemplated that multiple joints can be located along different points on the forebody depending on the amount of rearbody lift and the lift direction needed. FIG. 10 illustrates the bendable projectile II having two articulating joint units located along the forebody unit. During flight, the two joints allow the forebody to bend in the same direction as illustrated in FIG. 8*a* or in opposing directions as illustrated in FIG. 8*b*.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description but by the claims and any equivalents.

What is claimed is:

1. A bendable projectile comprising: an forebody unit, a rearbody unit and an articulating joint unit connecting the forebody unit and rearbody unit, and wherein the articulating joint unit is comprised of;

a. a generally spherical shape body wherein the spherical shape body is comprised of a plurality of concentric grooves located on the surface of at least one polar end of the spherical shape body, and the spherical shape body is fixed either to the forebody unit or the rearbody unit; and b. a fixed receiving socket for receiving and housing the spherical shape body, wherein the receiving socket is fixed on the projectile unit that is opposite from the spherical shaped body; and c. a sphere-gear assembly fixed on the projectile unit that is also opposite from the spherical shaped body, wherein the sphere-gear assembly comprises a driving gear and driven gear wherein the driven gear is in dynamic contact with the concentric grooves of the spherical shape body.

2. The bendable projectile of claim 1, wherein the sphere-gear assembly further comprises an electric board, power source, powertrain, and guidance control system.

3. The bendable projectile of claim 1, wherein the projectile further comprises fins and canards.

4. A bendable projectile of claim 1, wherein the forebody unit is comprised of a plurality of articulating joint units.

5. A bendable projectile comprising: an forebody unit, a rearbody unit and an articulating joint unit connecting the forebody unit and rearbody unit, wherein the articulating joint unit comprises;

a. a generally hollow spherical shape body wherein the spherical shape body is fixed either to the projectile forebody unit or the projectile rearbody unit; and b. a receiving socket having a plurality of concentric grooves on the concave surface and wherein the receiving socket receives and houses the spherical body, and wherein the receiving socket is fixed on the projectile unit that is opposite from the spherical shaped body; and c. a sphere-gear assembly situated inside the generally hollow spherical body and said sphere-gear assembly is fixed on the same projectile unit as the hollow spherical shape body, and wherein the sphere-gear assembly is comprised of a driving gear and a driven gear wherein the driven gear is in dynamic contact with the concentric grooves on the concave surface of the receiving socket.

6. The bendable projectile of claim 5, wherein the sphere-gear assembly is comprised of an electric board, power-source, powertrain, and guidance control system.

7. A bendable projectile of claim 5, wherein the forebody unit is comprised of a plurality of articulating joint units.

8. The bendable projectile of claim 5, wherein the projectile further comprises fins and canards.

* * * * *